US012291872B2

(12) United States Patent
Crowell et al.

(10) Patent No.: US 12,291,872 B2
(45) Date of Patent: May 6, 2025

(54) COMPONENTS FOR USE IN INSTALLING AND REPAIRING GUTTER GUARD SYSTEMS

(71) Applicant: LeafFilter North, LLC, Hudson, OH (US)

(72) Inventors: Jason Alan Crowell, Akron, OH (US); Michael Gori, Norton, OH (US)

(73) Assignee: LeafFilter North, LLC, Hudson, OH (US)

( * ) Notice: Subject to any disclaimer, the term of this patent is extended or adjusted under 35 U.S.C. 154(b) by 117 days.

(21) Appl. No.: 18/145,517

(22) Filed: Dec. 22, 2022

(65) Prior Publication Data

US 2024/0209636 A1 Jun. 27, 2024

(51) Int. Cl.
*E04D 13/076* (2006.01)
*E04D 13/068* (2006.01)

(52) U.S. Cl.
CPC ..... *E04D 13/076* (2013.01); *E04D 13/068* (2013.01)

(58) Field of Classification Search
CPC .... E04D 13/076; E04D 13/068; F16M 13/022
See application file for complete search history.

(56) References Cited

U.S. PATENT DOCUMENTS 3,297,285 A * 1/1967 Simmons ..... E04D 13/076 248/48.1
4,036,761 A * 7/1977 Rankin ..... E04D 13/076 52/12
4,750,300 A * 6/1988 Winger, Jr. ..... E04D 13/076 52/12
5,611,175 A * 3/1997 Sweers ..... E04D 13/076 52/12
5,740,633 A * 4/1998 Champagne ..... E04D 13/0725 52/11
5,819,476 A * 10/1998 Annestedt, Sr. ..... E04D 13/076 24/457
5,899,023 A * 5/1999 Byer ..... E04D 13/076 52/12
5,966,875 A * 10/1999 Kuhns ..... E04D 13/076 52/12

(Continued)

FOREIGN PATENT DOCUMENTS

WO WO-9405874 A1 * 3/1994 ..... E04D 13/0725

*Primary Examiner* — Monica E Millner
(74) *Attorney, Agent, or Firm* — Benesch Friedlander Coplan & Aronoff LLP

(57) ABSTRACT

Disclosed herein are novel components arranged for attachment to a rain gutter and useful for the installation or repair of gutter guard systems. One example is a clip that includes a back section and a front section extending from the bottom of the back section. The back section and the front section are generally perpendicular to each other. The back section includes a slot arranged to accommodate the rear edge of a rain gutter so that the clip can be attached to a rain gutter. The clip further includes two side members extending upward on either side of the front section. The side members each include an arm section that defines an opening in each side member. The openings are arranged to accommodate and secure features of gutter guard systems. In one example, the openings are arranged to accommodate legs extending rearward from a lower portion of gutter guard systems.

12 Claims, 17 Drawing Sheets

(56) References Cited

U.S. PATENT DOCUMENTS

| | | | | |
|---|---|---|---|---|
| 6,735,907 | B2 * | 5/2004 | Stevens | E04D 13/076 52/12 |
| 6,827,379 | B2 * | 12/2004 | Hill | A47F 5/0892 248/205.3 |
| 6,971,768 | B1 * | 12/2005 | Pepito | F21S 4/10 362/249.16 |
| 7,309,150 | B2 * | 12/2007 | Vendrick | F21S 4/10 362/152 |
| 7,677,504 | B2 * | 3/2010 | Hutchinson | E04D 13/076 52/12 |
| 8,545,041 | B2 * | 10/2013 | Brown | F21V 21/0885 24/336 |
| 8,888,337 | B2 * | 11/2014 | Adams, IV | F21S 4/10 362/396 |
| 11,913,626 | B2 * | 2/2024 | Felt | F21V 21/0885 |
| 2005/0011136 | A1 * | 1/2005 | Filippi | E04D 13/076 52/11 |
| 2005/0108951 | A1 * | 5/2005 | McDonald | E04D 13/064 52/11 |
| 2006/0152927 | A1 * | 7/2006 | Vendrick | F21S 4/10 362/249.01 |
| 2009/0025303 | A1 * | 1/2009 | Gramling | E04D 13/076 248/48.1 |
| 2016/0376790 | A1 * | 12/2016 | Yildiz | E04D 13/064 52/12 |
| 2022/0275648 | A1 * | 9/2022 | Lenney | E04D 13/076 |
| 2023/0358048 | A1 * | 11/2023 | Sutton | E04D 13/076 |

* cited by examiner

FIG. 9 - PRIOR ART

COMPONENTS FOR USE IN INSTALLING AND REPAIRING GUTTER GUARD SYSTEMS

FIELD OF INVENTION

The present disclosure generally relates to components that facilitate the installation of gutter guard systems. More specifically, the present disclosure relates to a clip, a hanger with an integrated clip, and a fastener for use in installing new gutter guard systems and repairing and reinstalling existing gutter guard systems.

BACKGROUND

Rain gutter systems are commonly used for residential homes, buildings, and other structures to manage rainwater by collecting the rainwater and channeling that rainwater away from the structure. Such management of rainwater can be critical for the overall maintenance and condition of the structure by reducing or eliminating damage to the structure and its foundation that can be caused by the uncontrolled flow of rainwater. Gutter guards systems are typically attached to or incorporated into rain gutters to prevent leaves, pine needles, branches, soot, and other such debris from entering the rain gutter. Such debris can clog the rain gutter and reduce its effectiveness in channeling rainwater away from a residential home, building, or other structure. In addition, such debris can damage and shorten the service life of a rain gutter system by causing corrosion, pitting, or other deleterious effects on the rain gutter system.

Installation of gutter guard systems can be challenging. Rain gutters come in a variety of styles and sizes, the gutter guard systems themselves also come in a variety of styles and sizes, and the roof lines that such rain gutters and gutter guard systems are attached to also can vary greatly in style and arrangement. Thus, the installation or repair and reinstallation of gutter guard systems is not often a straightforward process. Such work often requires that the installer use his or her ingenuity to craft a creative solution. Therefore, there is a need in the gutter guard installation and repair industry to provide installers with additional components that can accommodate different arrangements of gutter guards, rain gutters, and rooflines. Disclosed herein are such novel component for use in installing and repairing gutter guard systems.

SUMMARY

Disclosed herein are novel components useful for the installation or repair of gutter guard systems. The components are arranged to be readily attached to a rain gutter and once attached are arranged to support and secure a gutter guard system relative to the rain gutter. One such component is a clip. In one example, a clip includes a back section and a front section extending from the bottom of the back section. The back section is generally vertical and the front section is generally horizontal. However, in certain embodiments a plane defining the back section and a plane defining the front section can be at an obtuse angle to one another. The back section includes a slot arranged to accommodate the rear edge of a rain gutter so that the clip can be attached to a rain gutter. The clip further includes two side members extending upward on either side of the front section. The side members each include an arm section that defines an opening in each side member. The openings are arranged to accommodate and secure features of gutter guard systems. In one example, the openings are arranged to accommodate legs extending rearward from a lower portion of a gutter guard system.

Another such component is a hanger. In one example, the hanger includes a front end and a back end connected by a body, where the front end and a back end are arranged to secure the hanger to a rain gutter. The back end is generally perpendicular to the body and includes an aperture by which the hanger can be secured to a rear section of the rain gutter by a fastener. The back end further includes a pair of ribs that extend horizontally from the back end toward the front end of the hanger. The pair of ribs are arranged to accommodate and secure a portion of a gutter guard system. In one example, a gutter guard systems include legs or other rearward extending features that are accommodated and secured between the pair of ribs and the body of the hanger.

Another component is a hanger as previously described but includes an integrated clip. In one example, the hanger includes a front end and a back end connected by a body arranged to secure the hanger to a rain gutter. However, the back end is arranged as a clip that includes a generally u-shaped body forming a downward extending slot arranged to capture the rear edge of a rain gutter so as to secure the hanger to the rear edge of the rain gutter. The back end further includes a pair of ribs that extend horizontally from the u-shaped body toward the front end of the hanger. The pair of ribs are arranged to accommodate and secure a portion of a gutter guard system. In one example, a gutter guard systems include legs or other rearward extending features that are accommodated and secured between the pair of ribs and the body of the hanger.

Another such component is a novel fastener. The fastener includes a head, a flange extending outward from the bottom of the head, a cylindrical section extending longitudinally from the flange, a floating washer positioned adjacent to the cylindrical section, and a threaded section. The head, flange, cylindrical section, and floating washer are arranged to support and secure a gutter guard system when the fastener is installed in a rain gutter. The floating washer is arranged to ensure that the head, flange, and cylindrical section extending inward from a rear edge of the rain gutter when installed. For gutter guard systems that include a rearward extending feature, such as a leg, such a feature can be secured under the portions of the fastener extending inward into the rain gutter. In one example, the head of the fastener engages with a portion of the leg to further secure the gutter guard system.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

Figure 1:
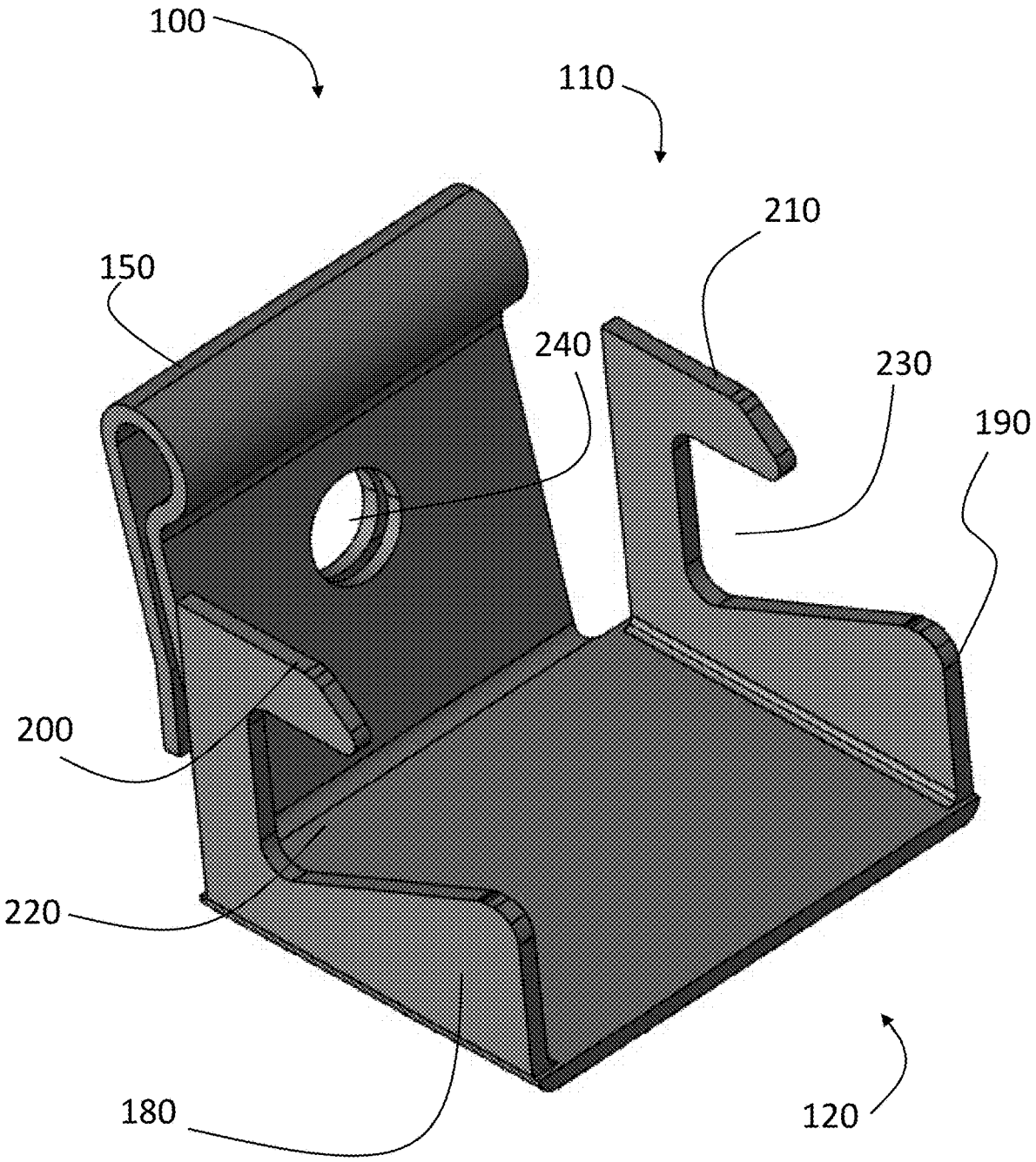
FIG. 1 schematically illustrates a perspective view of an exemplary clip for use in installing or repairing a gutter guard system.
Figure 2:
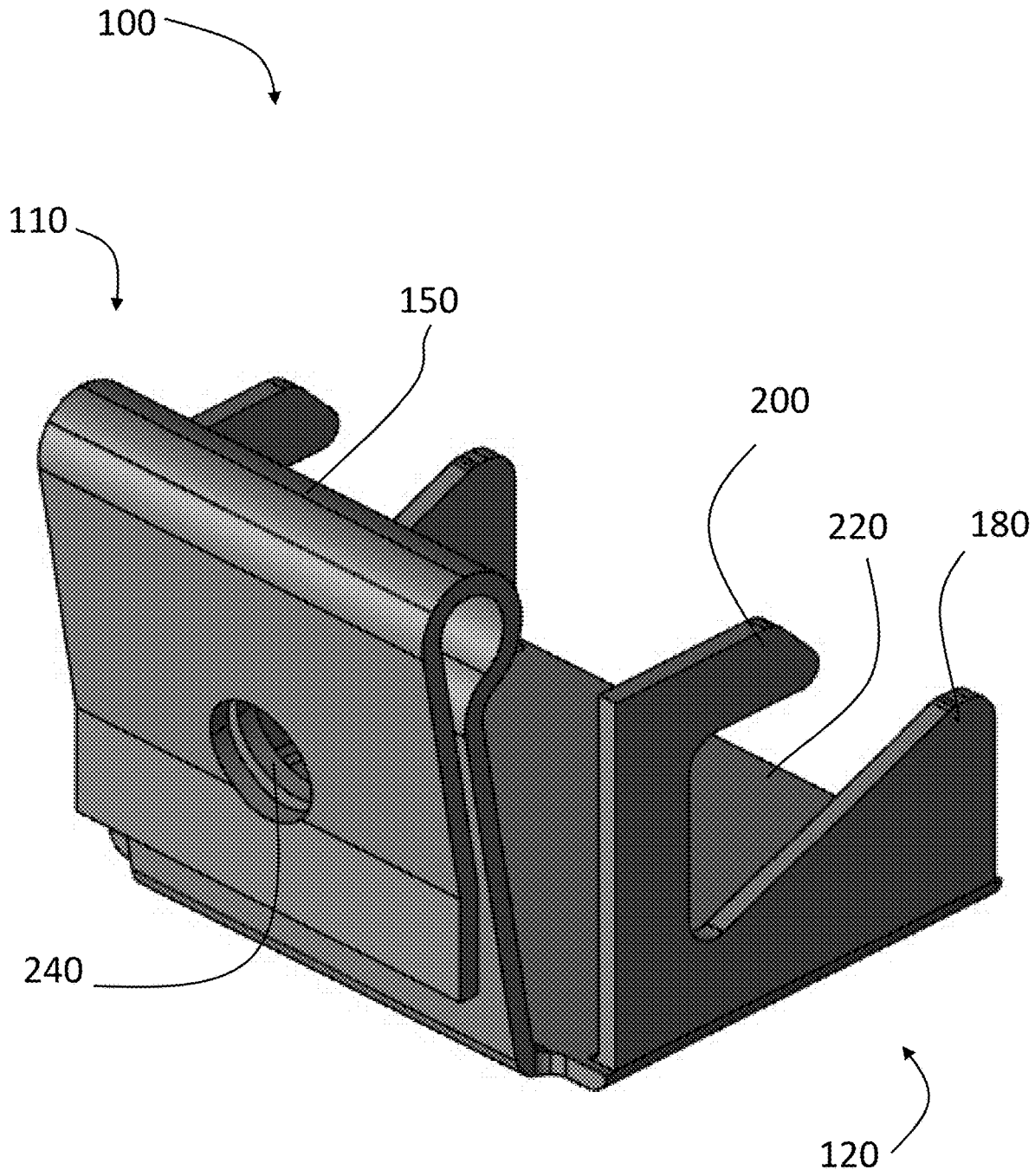
FIG. 2 schematically illustrates another perspective view of the clip of FIG. 1
Figure 3:
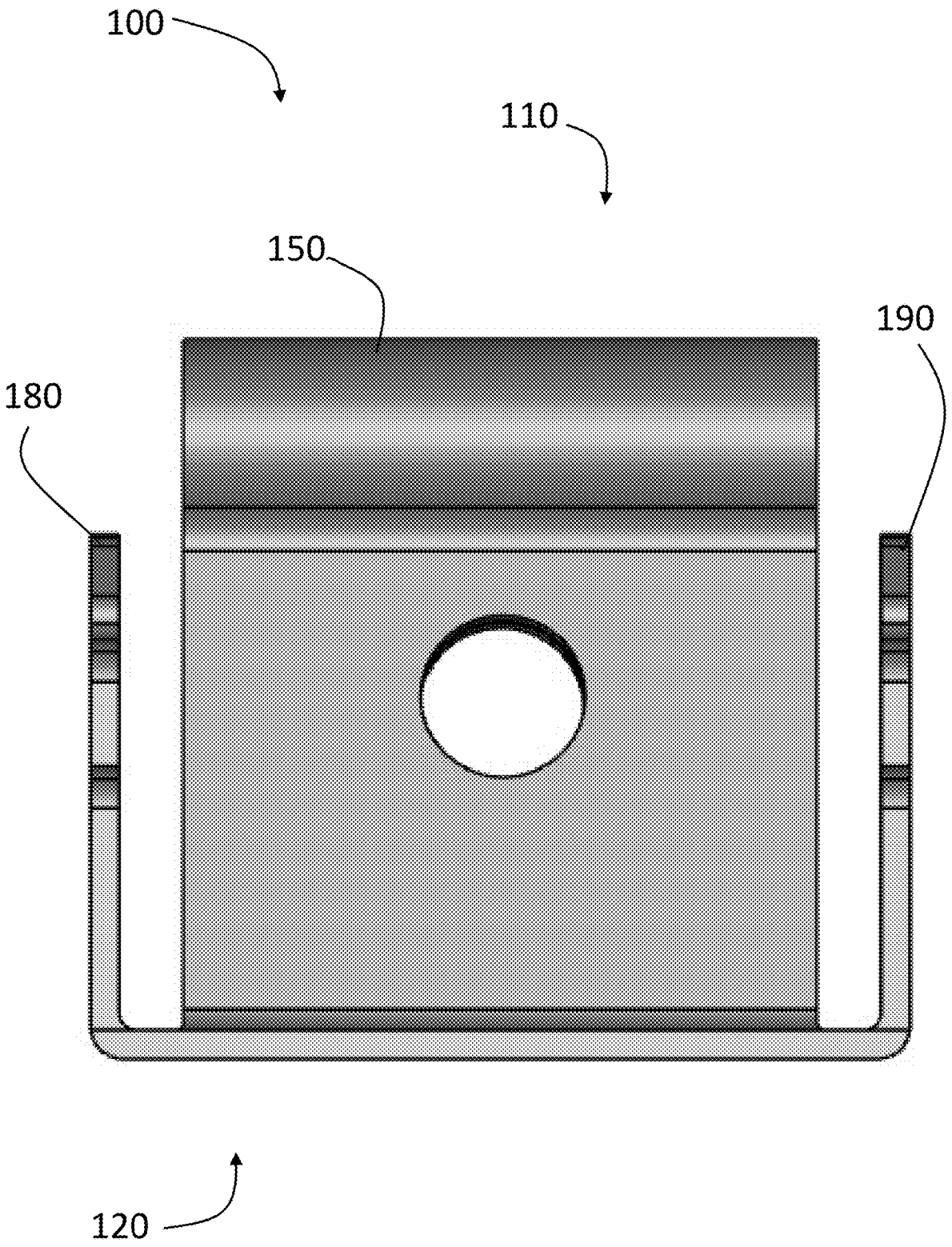
FIG. 3 schematically illustrates a side view of the clip of FIG. 1.

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of components for installing and repairing and reinstalling gutter guard systems are hereinafter disclosed and described in detail with reference made to FIGS. 1-17.

FIGS. 1-4 schematically illustrates an exemplary clip 100 for use in installing and repairing and reinstalling gutter guard systems. Specifically, the clip 100 is arranged to be secured to a rain gutter and subsequently engage with a gutter guard system to facilitate the installation of the gutter guard system into or onto a rain gutter. As will be evident from the description and disclosure of the clip 100 herein, the clip 100 can be used for a new installation of a gutter guard system but may be most useful as a component used to repair existing gutter guard systems and reinstalling such systems. Once a gutter guard system is installed, it is expected to have a significantly long service life. However, like all systems used outdoor in the elements, gutter guard systems do deteriorate over time or are subject to extreme weather condition that can damage to gutter guard system. Under such circumstances, it is often most cost effective to repair and reinstall the existing gutter guard system instead of replacing the gutter guard system with a new system.

The clip 100 is generally L-shaped with a back section 110 that extends generally vertically upward and a front section 120 that extends generally horizontally away from the bottom of the back section 120. While the back section 110 is described as extending vertically upward and the front section 120 is described as extending generally horizontally, the relative planes of the back section 110 and front section 120 can be positioned at an obtuse angle. In one embodiment, the plane of the back section 110 is at an approximately 100 degree angle to the plane of the front section 120. The clip can be manufactured with a number of different angles between the front 120 and back 110 sections (such as 90 degrees, 100 degrees, etc.) to accommodate a number of different arrangements of rain gutters and gutter guard systems. Additionally, the clip can be manufactured so that the angle between the front 120 and back 110 sections can be adjusted by a tool through mechanical force to adjust the angle for the specific installation or repair. This is to say, the angle between the back section 110 and the front section 120 can be manufactured or subsequently adjusted to an angle that accommodates the installation of a specific gutter guard system into or onto a specific rain gutter.

Figure 4:
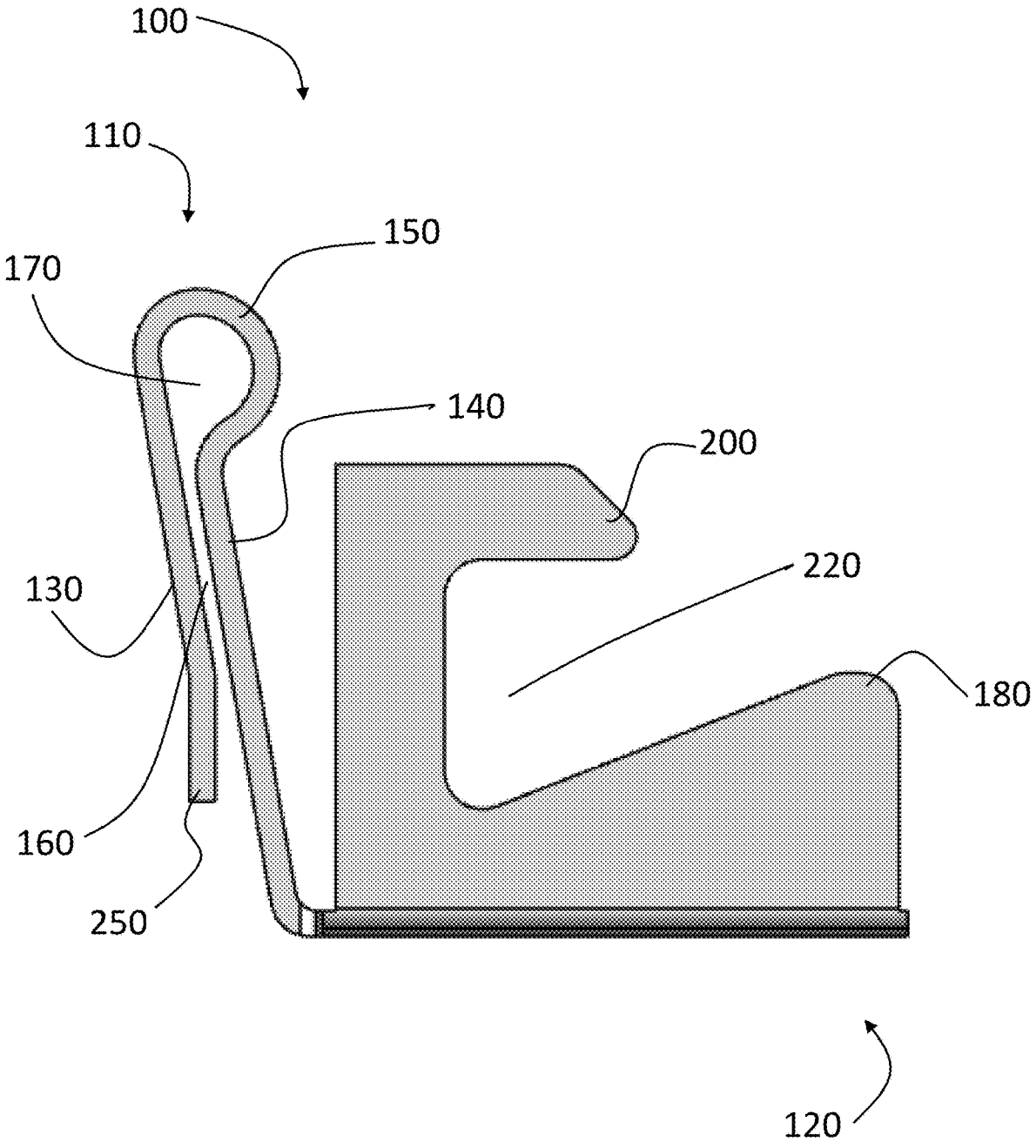
FIG. 4 schematically illustrates a front view of the clip of FIG. 1.

As best illustrated in FIG. 4, the back section 110 includes two generally flat members 130, 140 joined together by a rounded section 150. The two flat members 130, 140 are arranged such that a slot 160 is formed between them, and the rounded section 150 forms a passage 170 above the two flat members 130, 140. The clip 100 includes a pair of side members 180, 190 extending upwards from each side of the front section 120. Each side member 180, 190 includes an arm 200, 210 and an opening 220, 230 formed between the arm 200, 210 and the remainder of the side member 180, 190. The clip 100 includes an aperture 240 passing through the two flat members 130, 140.

Figure 5:
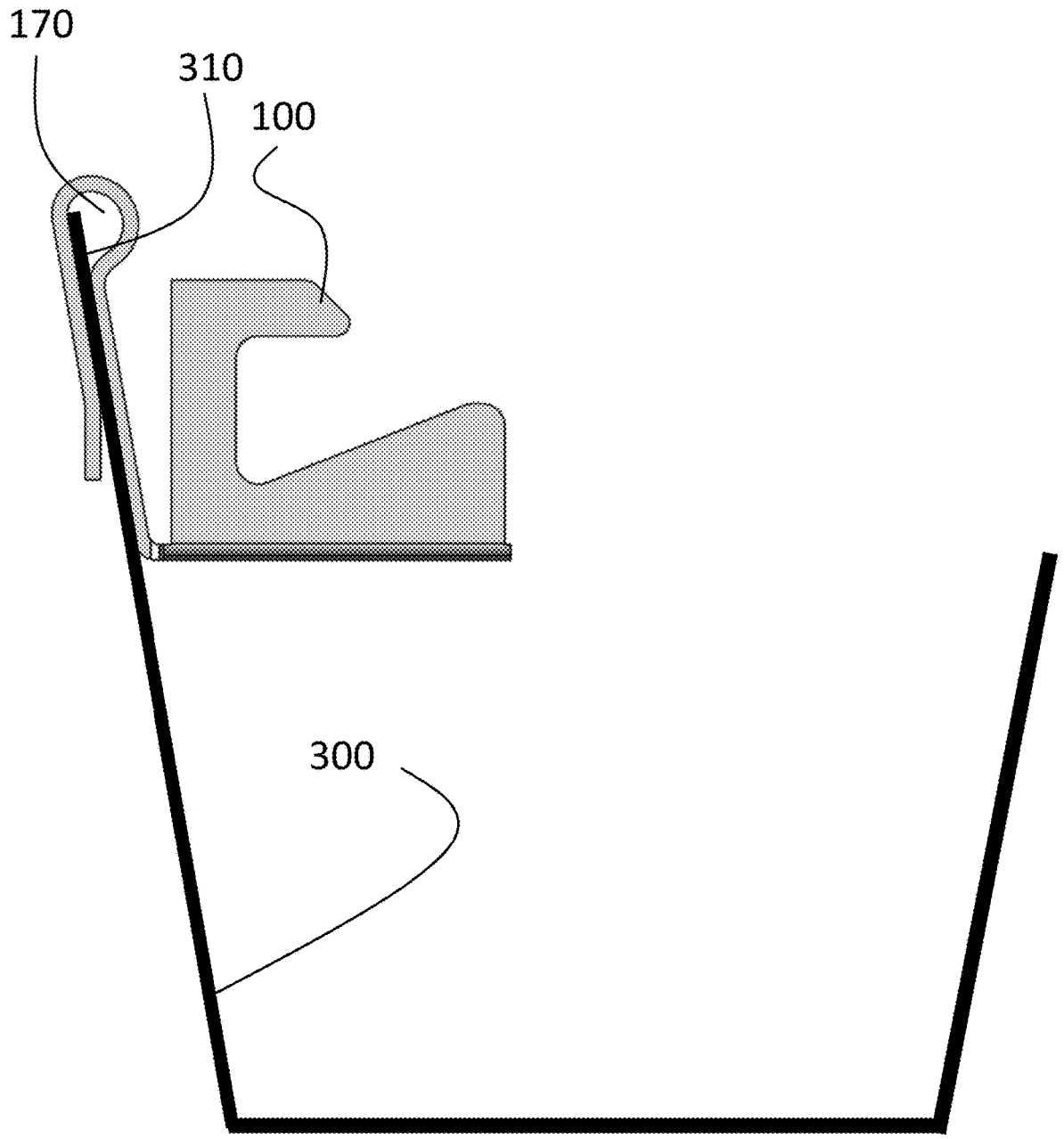
FIG. 5 schematically illustrates a side view of the clip of FIG. 1 attached to a rain gutter.
Figure 6:
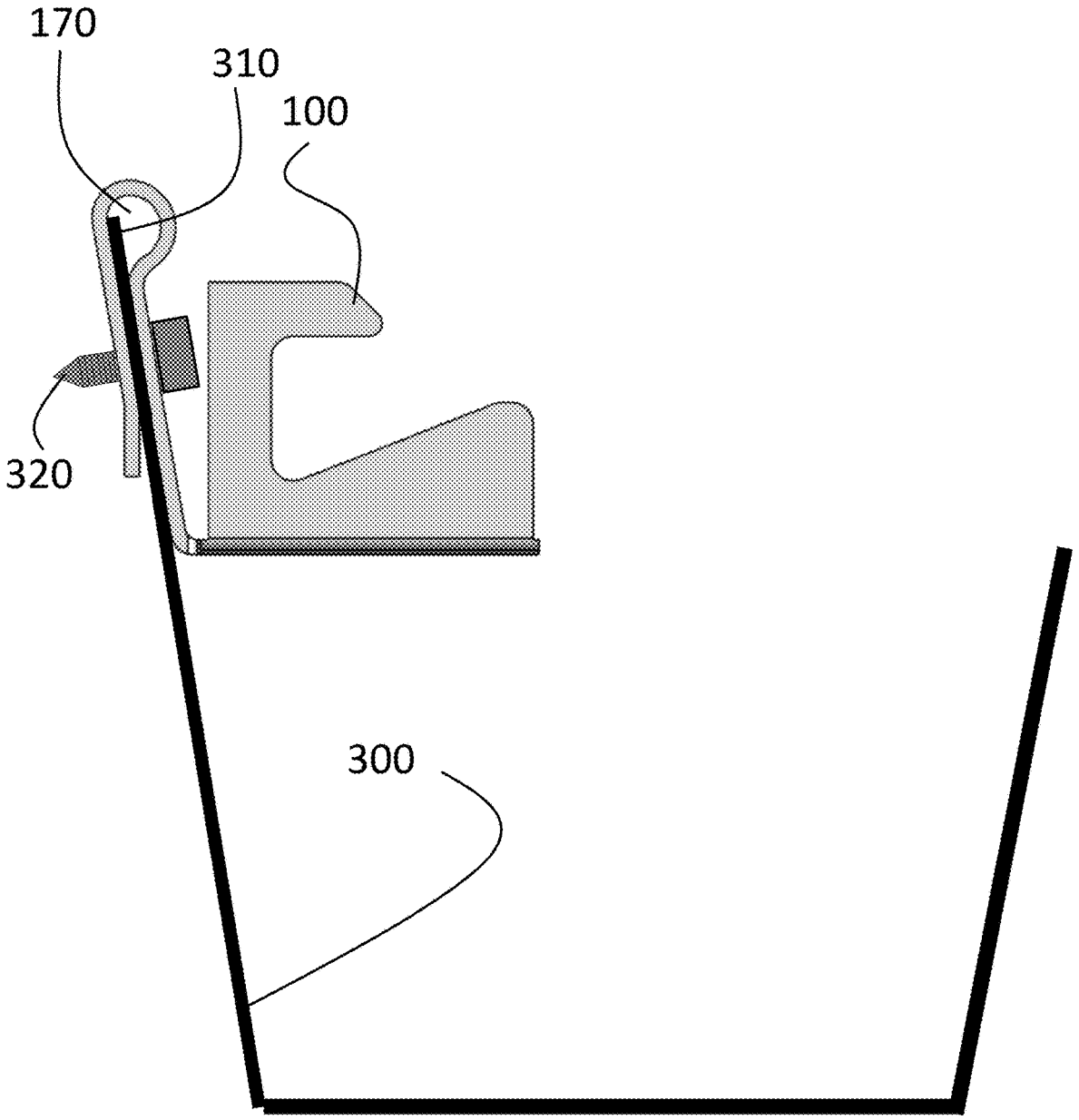
FIG. 6 schematically illustrates a side view of the clip of FIG. 1 attached to a rain gutter using a fastener.
Figure 7:
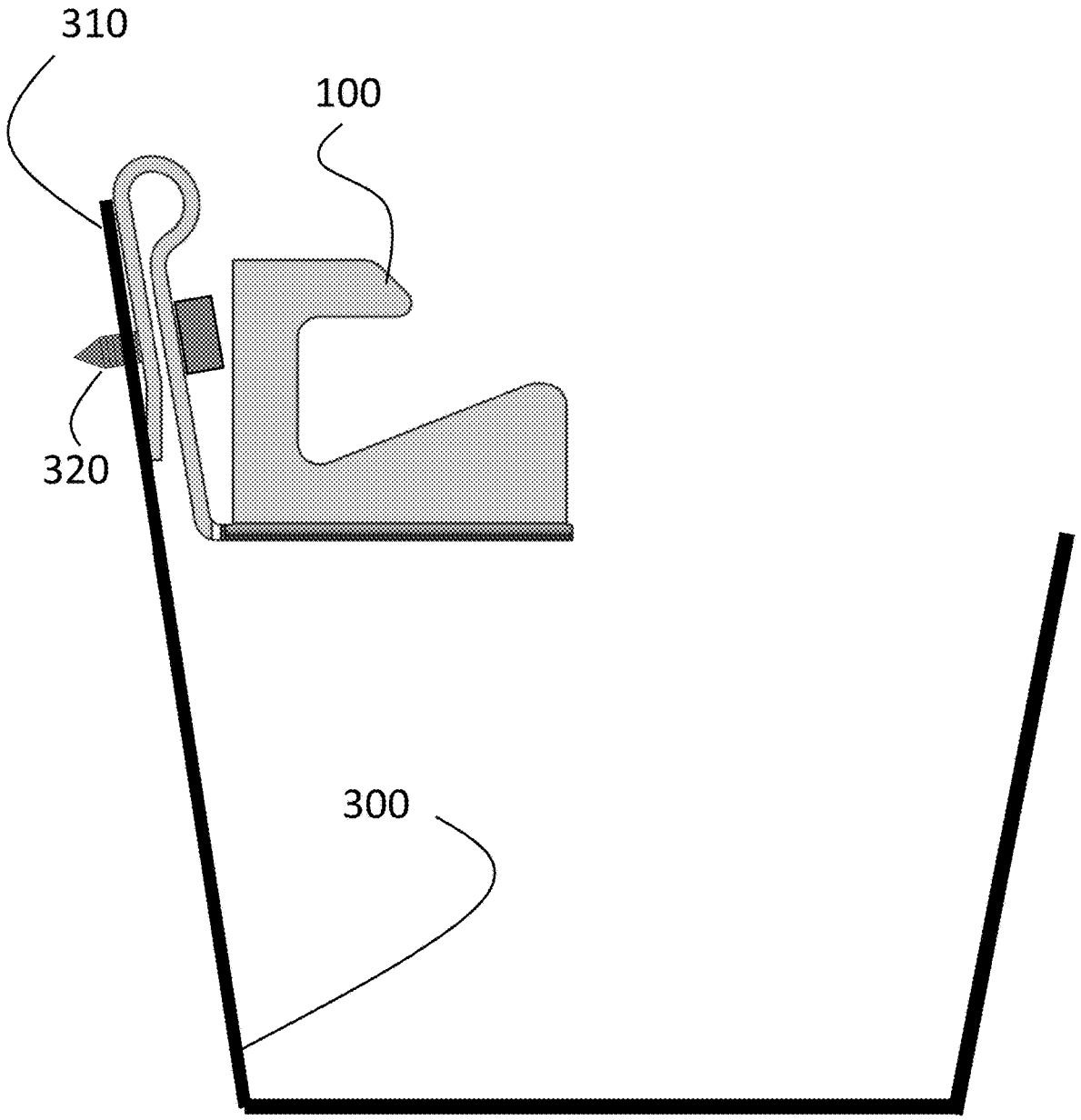
FIG. 7 schematically illustrates a side view of the clip of FIG. 1 attached in an alternative arrangement to a rain gutter using a fastener.

FIGS. 5-7 schematically illustrate alternative methods for securing a clip 100 to a rain gutter 300. As illustrated in FIG. 5, the clip 100 is arranged so that the clip 100 can be attached to a rain gutter 300 by inserting a rear edge 310 of the rain gutter 300 into the slot 160 in the back section 110 of the clip 100. As illustrated in FIG. 6, if necessary or desirable, the clip 100 can be further secured to the rain gutter 300 and/or structure by passing a fastener 320 through the aperture 240 of the clip 100, the rain gutter 300 and/or the structure. It will be appreciated that the passage 170 above the slot 160 can accommodate a rear edge 310 of a rain gutter 300 that includes a rounded, folded over section, or other such feature at the top end of the rear edge 310 that is dimensionally larger than the thickness of the remainder of the rear edge 310.

As illustrated in FIG. 7, in another alternative arrangement, the clip 100 can be positioned fully inside the rain gutter 300 and a fastener 320 can be used to secure the clip 100 to the rain gutter 300 by passing the fastener 320 through the aperture 240 of the clip 100, through rear edge 310 of the rain gutter 300, and/or into the structure. Such an arrangement may be best utilized when a rain gutter 300 is installed under a drip edge or other such obstruction that blocks access to the back of the rain gutter 300.

Once attached to the rain gutter, the clip 100 can be used to support a gutter guard system. As noted above, the back section 110 and front section 120 are not necessarily perpendicular to each other. The back section 110 and front section 120 can be positioned at an obtuse angle. As illustrated in FIG. 4, in such a scenario, the back section 120 is inclined rearward compared to the front section 120. In such an arrangement, once the clip 100 is attached to the rear edge of the rain gutter, this rearward incline of the back section 110 determines the orientation of the front section 120. For example, if the rear edge of the rain gutter is generally vertical, when the clip 100 is attached to the rain gutter, the front section 120 will be positioned such that it declines at it extends toward the front of the rain gutter. This may be desirable if the best position of the gutter guard system is to decline as it extends away from the roofline. If the rear edge of the rain gutter is also inclined rearward, when the clip 100 is attached to the rain gutter, the front section 120 will be positioned such that it extends horizontally toward the front of the rain gutter. This may be desirable if the best position of the gutter guard system is to remain horizontal as it extends away from the roofline or if the structure of the gutter guard system includes a declining top surface with a horizontal bottom surface. In an embodiment, the flat member 130 can include a tale 250 at the bottom of the flat member 130 (see FIG. 4) that angles away from the other flat member 140 so as to create a larger opening to the slot 160, which can make it easier for the installer to attach the clip 100 to the rain gutter by inserting the rear edge of the rain gutter into the slot 160.

The side members 180, 190 with their arms 200, 210 and openings 220, 230, are arranged to support a gutter guard system. Many gutter guard systems include legs or other features extending rearward from the gutter guard system. The openings 220, 230 in the side members 180, 190 are arranged to capture such rearward extending legs or features to secure the gutter guard system in place either above or within a rain gutter. Specifically, once the legs or other features of the gutter guard system are captured in the openings 223, 230, upward and downward movement of the gutter guard system is restrained by the clip 100.

Figure 8:
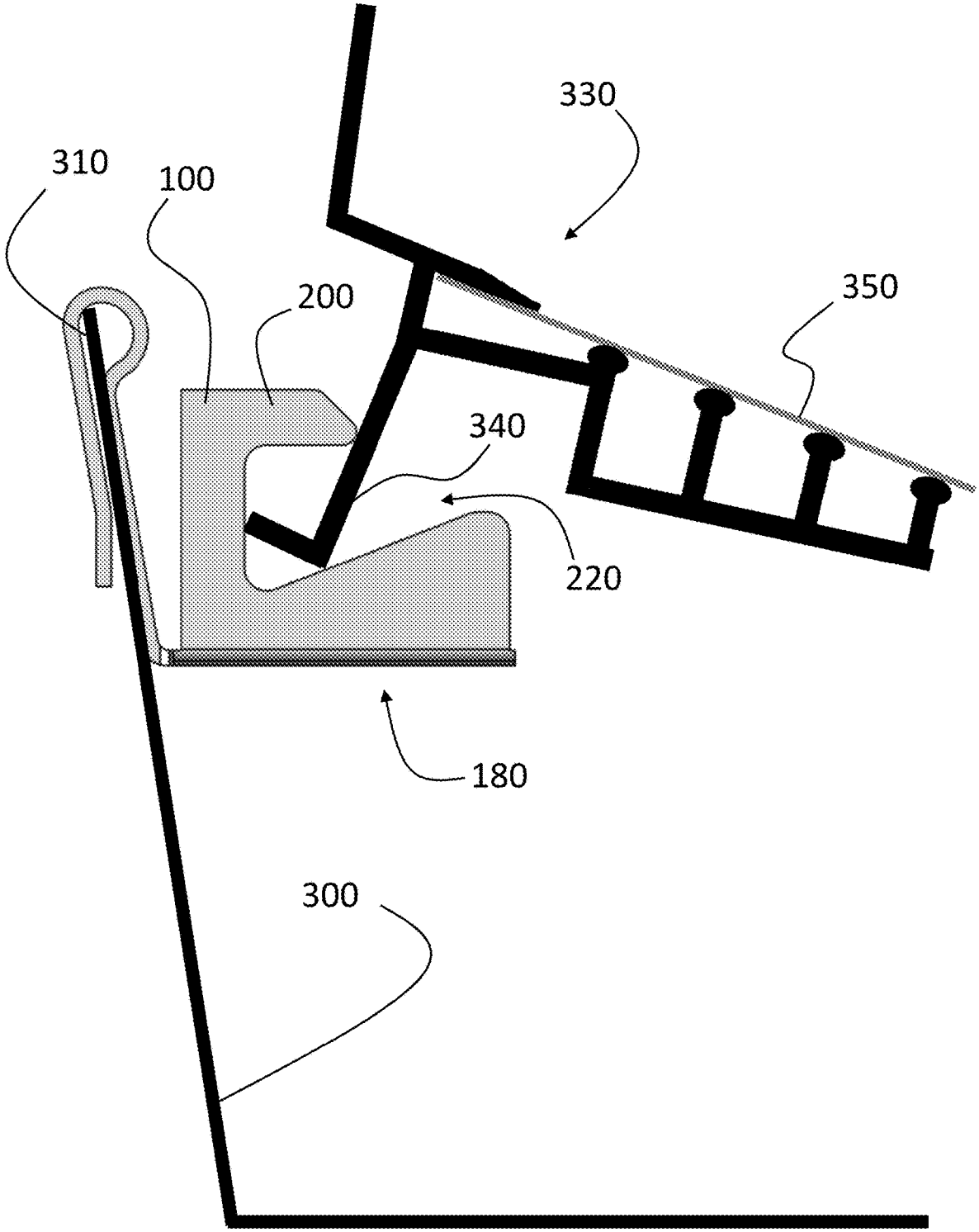
FIG. 8 schematically illustrates as side view of the clip of FIG. 1 attached to a rain gutter and securing a gutter guard system.

FIG. 8 schematically illustrates a side view of a clip 100 secured to a rain gutter 300 and securing and supporting a gutter guard system 330. FIG. 8 illustrates only the rearward portions of the rain gutter 300 and gutter guard system 330. As noted above, the gutter guard system 330 can include a leg 340 extending rearward from the gutter guard system 330. The arms 200, 210 and openings 220, 230 of the side members 180, 190 capture and support the leg 340 of the gutter guard system 330. In this example, once the gutter guard system 330 is installed, upward and downward movement of the gutter guard system 330 is restrained by the clip 100. As illustrated, the rear edge 310 of the rain gutter 300 is inclined rearward and the back section 110 and slot 160 are also include rearward. In such arrangement, when the clip 100 is secured to the rear edge 310 of the rain gutter 300, the front section 120 will extend generally horizontally away from the back section 110. As illustrated, the gutter guard system 330 is arranged such that once it is installed over the rain gutter 300, the top surface 350 of the gutter guard system 330 declines as it extends toward the front of the rain gutter 300. Thus, the obtuse angle between the front section 120 and back section 110 accommodates this particular design of gutter guard system 330.

The clip 100 can be fabricated from relatively thin spring steel. Such thin spring steel makes it easier for an installer to secure the clip 100 to a rain gutter and limits concerns regarding interference with other components of the rain gutter, gutter guard system, etc. Additionally, the spring steel is generally rigid, which provides forces that properly align components of the gutter guard system. For example if several clips are spaced apart and supporting and securing a long length of a gutter guard system that is warped or otherwise not generally flat, the spring steel construction can in essence force the warped section of the gutter guard system into a generally flat arrangement once installed. Thus, providing for a better performing gutter guard system. The spring steel construction also facilitates attaching the clip 100 to a rear edge of a rain gutter. Due to its resilient nature, the rearward flat member 130 that forms the rear wall of the slot 160 (as best illustrated in FIG. 4) can be temporarily flexed rearward to widen the slot during the installation process. Once the clip 100 is installed on the rain gutter, the flat member 130 returns to its original position to apply a clamping force on the rear edge of the rain gutter. In one embodiment, the clip 100 is fabricated from a single sheet of string steel to form a single integrated component.

From the description and illustrations herein, it will be understood that the clip 100 provides an installer with a component that is relatively compact in size and easy to attach to a rain gutter that can be used to position and secure gutter guard systems within a rain gutter either for a new installation of for repair and reinstallation of a gutter guard system.

Figure 9:
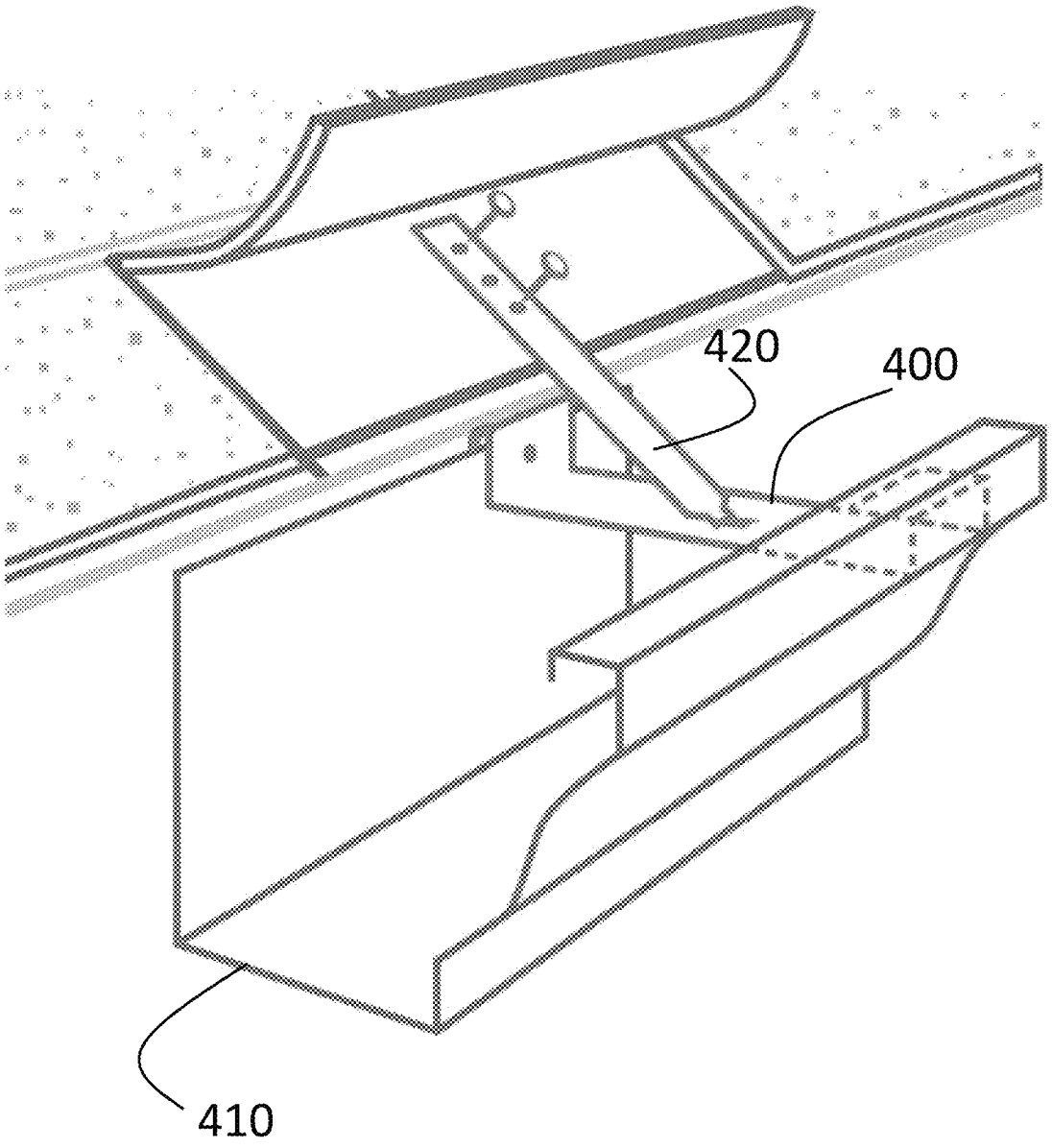
FIG. 9 schematically illustrates a prior art hanger and strap system for supporting a rain gutter.

It is common in the rain gutter installation industry to use hangers to support rain gutters. Such an arrangement is illustrated in FIG. 9. Hangers 400 typically attach to the front and rear edges of a rain gutter 410 to span the top opening of the rain gutter 410. A strap 420 is often employed to provide support to the hanger 400. One end of the strap 420 is typically attached to the hanger 400 and the other end of the strap 420 is secured to the roof of the structure. However, such an arrangement can interfere with the installation of gutter guard systems. In addition, typical hangers are not arranged to secure gutter guard systems.

Figure 10:
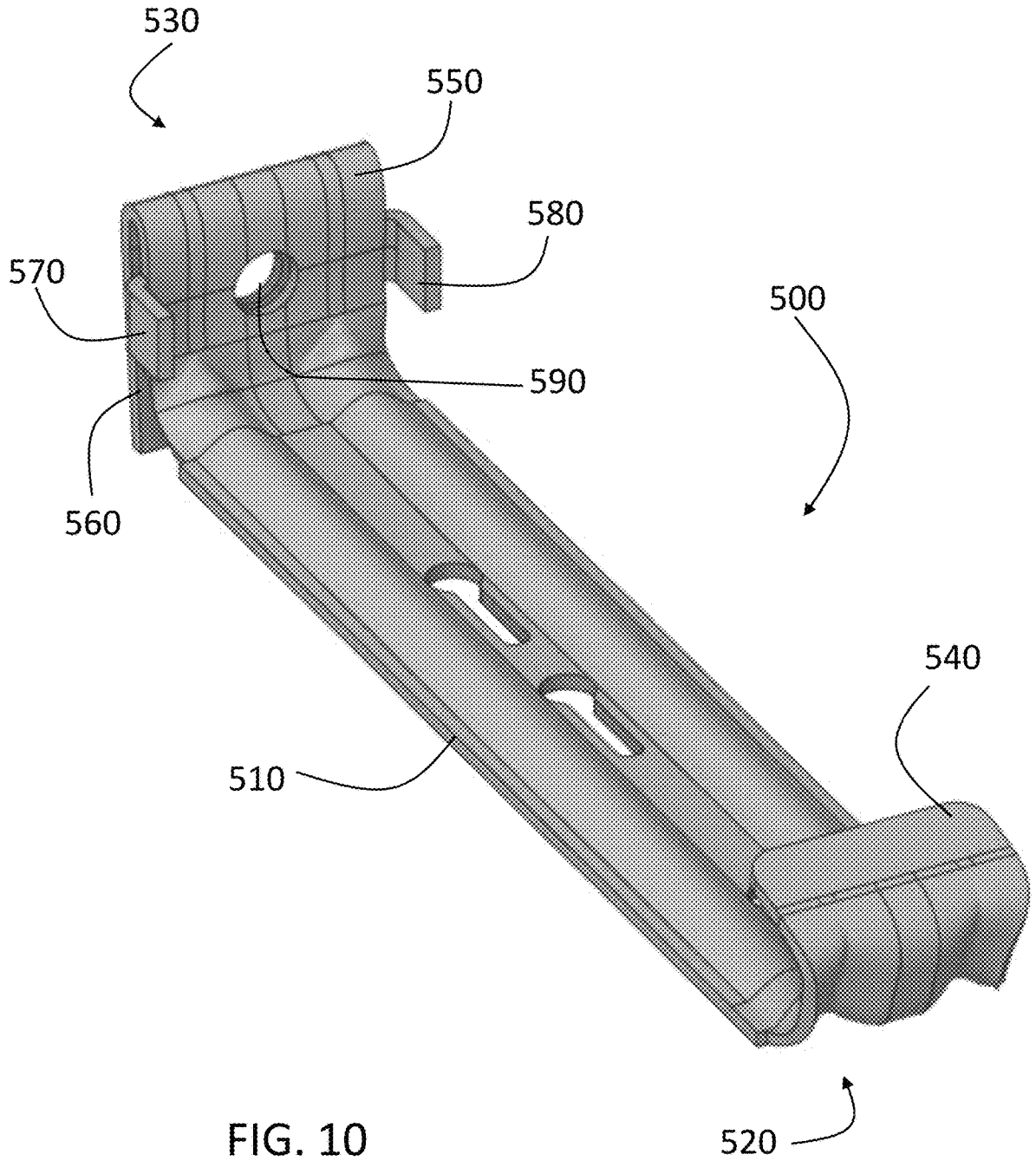
FIG. 10 schematically illustrates a perspective view of an exemplary hanger with an integrated clip for use in installing or repairing a gutter guard system.

Disclosed herein are novel hangers for securing gutter guard systems. A first novel hanger that includes an integrated clip 500 is illustrated in FIG. 10. The hanger 500 includes a body 510 with a front end 520 and a back end 530. The front end 520 includes a hooked portion 540 arranged to engage and attach to a front end of a rain gutter. The back end 530 is arranged to form a clip similar in structure to the prior described clip 100. The clip portion of the back end 530 is formed to by a generally u-shaped body 550 that defines a downward extending slot 560. The slot 560 is arranged to capture the rear edge of a rain gutter so as to secure the hanger 500 to the rear edge of the rain gutter. The back end 530 includes a pair of ribs 570, 580 that extend horizontally from the u-shaped body 550 toward the front end 520. The u-shaped body 550 also includes an aperture 590 formed through the u-shaped body 560. If needed or desired, once a rear edge of the rain gutter is positioned within the slot 560, a fastener can be passed through the aperture 590, through the rain gutter, and/or into the structure to further secure the hanger to the rain gutter. Additionally, in an alternative embodiment, the entire back end 530 of the hanger 500 can be positioned within the rain gutter and a fastener can be passed through the aperture 590, through the rain gutter, and/or into the structure to further secure the hanger 500 to the rain gutter.

Similar to the description of the clip 100, the pair of ribs 570, 580 are arranged to capture and secure a portion of a gutter guard system during the installation of the gutter guard system onto a rain gutter. Legs or other rearward extending features of a gutter guard system can be positioned between the pair of ribs 570, 580 and the body 510 of the hanger 500 during installation. Once the gutter guard system is installed and the gutter guard system is positioned over the top of the rain gutter, the pair of ribs 570, 580 and the body 510 of the hanger 500 will constrain vertical movement of the gutter guard system. Additionally, the gutter guard system can rest on top of the hanger, further supporting and stabilizing the gutter guard system to facilitate a long service life.

Figure 11:
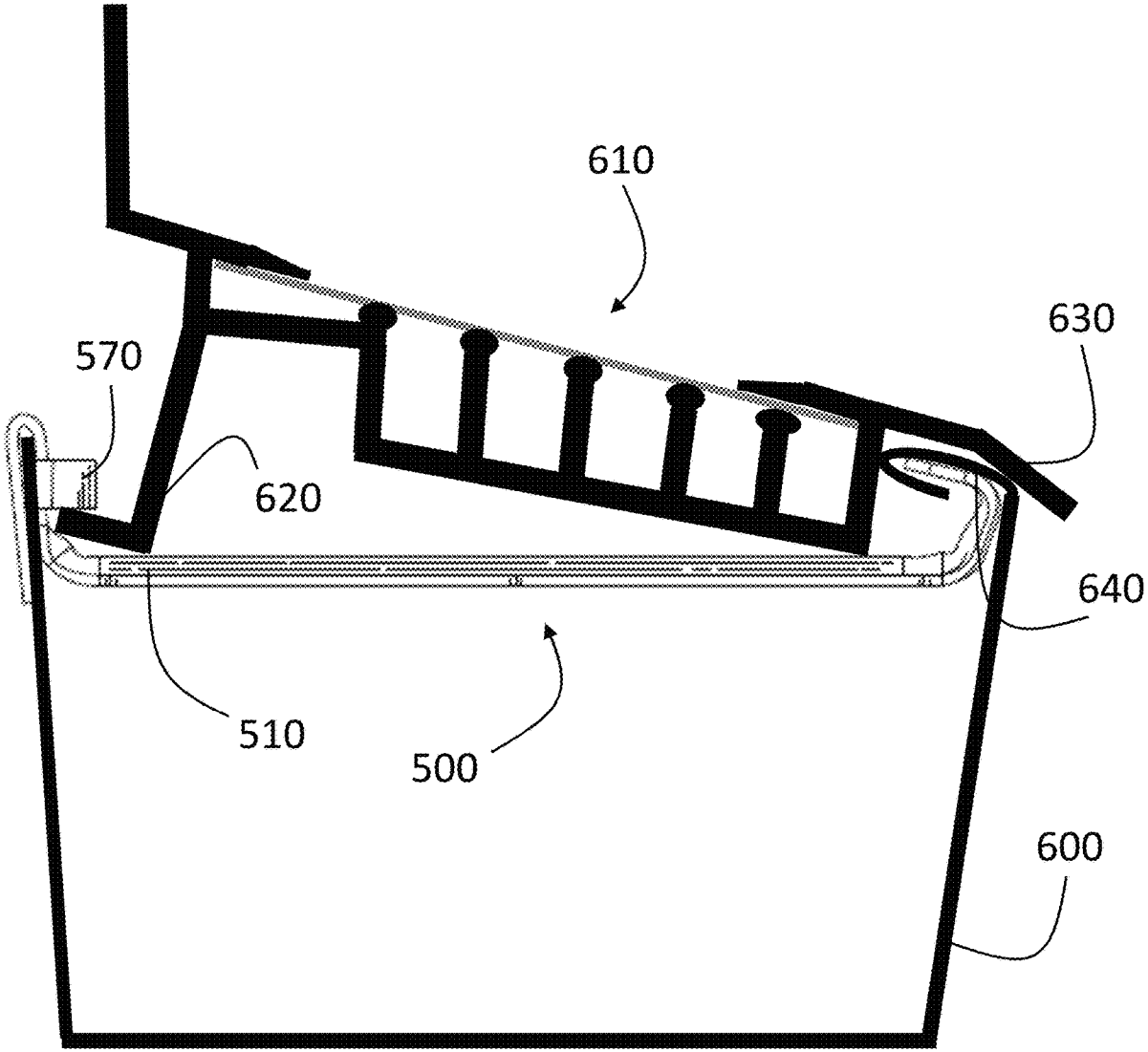
FIG. 11 schematically illustrates a side view of the hanger of FIG. 10 attached to a rain gutter and securing a gutter guard system.

FIG. 11 schematically illustrates a hanger 500 secured to a rain gutter 600 and a gutter guard system 610 secured and supported by the hanger 500. The gutter guard system 610 includes a leg 620 extending rearward. As illustrated, the leg 620 can be captured between the pair of ribs 570, 580 and the body 510 of the hanger 500 such that the gutter guard system 610 is secured and vertical movement of the gutter guard system 610 is constrained. It is noted that the front section 630 of the gutter guard system 610 rests on the front lip 640 of the rain gutter 600. In such an arrangement, an installer can first place the leg 620 into the space between the pair of ribs 570, 580 and the body 510 of the hanger 500 and then rotate the gutter guard system downward until the front section 630 of the gutter guard system 610 rests on the front lip 640 of the rain gutter 600. It will be understood that the gutter guard system 610 illustrated in FIG. 11 is only an exemplary embodiment of a gutter guard system that can benefit from the novel components described herein. Other gutter guard systems with different designs and different dimensions can be used with the components described herein. For example, such gutter guard systems can be of different widths to accommodate different rain gutter widths and can include different arrangements of main body and screen combinations and still benefit from the components described herein.

As with the prior described clip 100, from the description and illustrations herein, it will be understood that the hanger with an integrated clip 500 provides an installer with an additional component that is easy to attach to a rain gutter that can be used to position and secure gutter guard systems within a rain gutter either for a new installation of for repair and reinstallation of a gutter guard system.

Figure 12:
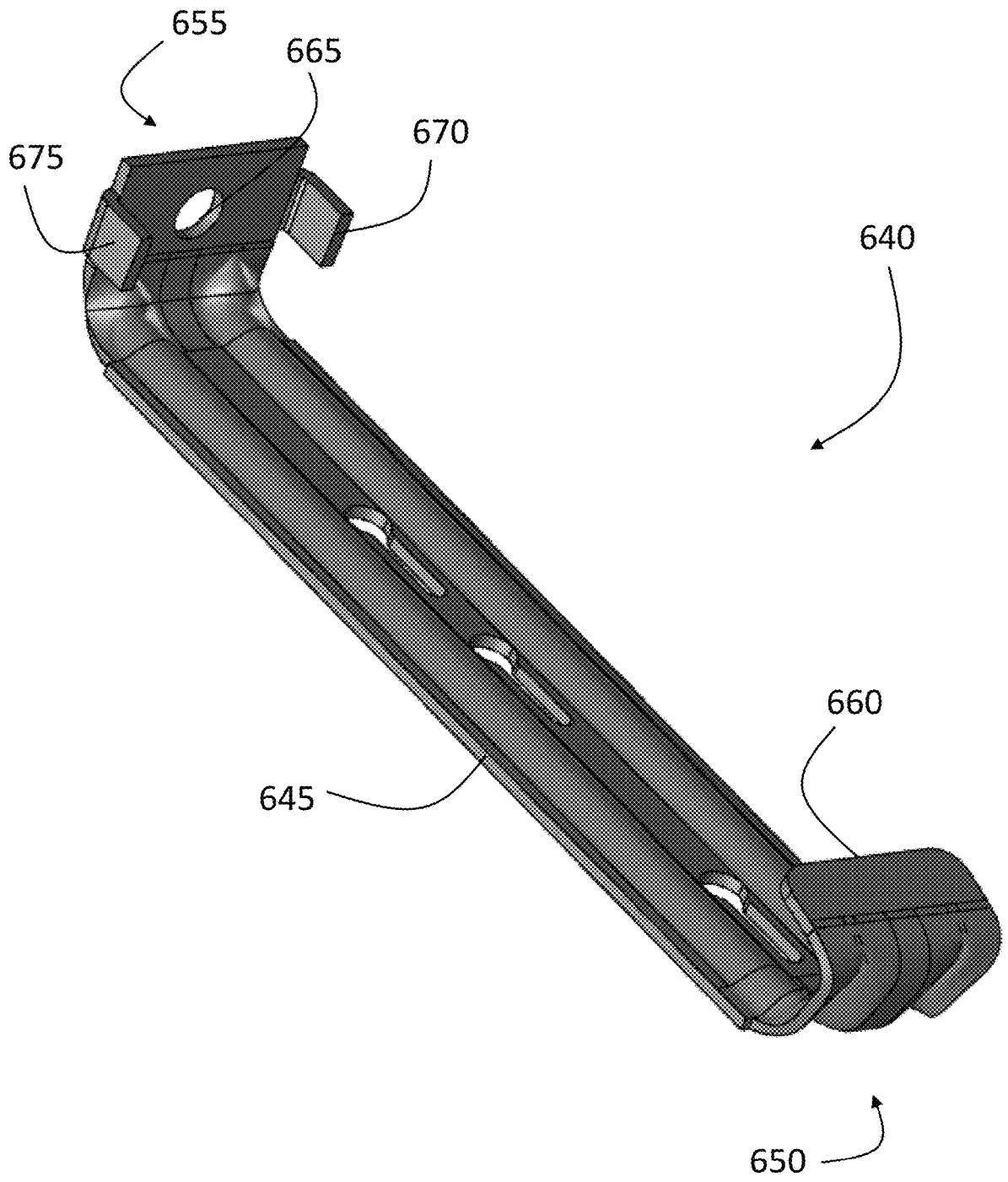
FIG. 12 schematically illustrates a perspective view of an exemplary clipless hanger for use in installing or repairing a gutter guard system.

A second novel hanger 640, illustrated in FIG. 12 is similar to the novel hanger that includes an integrated clip 500 as illustrated in FIGS. 10-11. However, the hanger 640 does not include an integrated clip. The clipless hanger 640 includes a body 645 with a front end 650 and a back end 655. The front end 650 includes a hooked portion 660 arranged to engage and attach to a front end of a rain gutter. The back end 655 includes an aperture 665 arranged to accommodate a fastener for securing the hanger 640 to the rain gutter and/or structure. The back end 655 further includes a pair of ribs 670, 675 that extend horizontally from the back end 655 toward the front end 650. As with the previously described hanger, 500, the pair of ribs 670, 675 are arranged to capture and secure a portion of a gutter guard system during the installation of the gutter guard system onto a rain gutter. Legs or other rearward extending features of a gutter guard system can be positioned between the pair of ribs 670, 675 and the body 645 of the hanger 640 during installation. Once the gutter guard system is installed and the gutter guard system is positioned over the top of the rain gutter, the pair of ribs 670, 675 and the body 645 of the hanger 640 will constrain vertical movement of the gutter guard system. Additionally, the gutter guard system can rest on top of the hanger, further supporting and stabilizing the gutter guard system to facilitate a long service life.

Figure 13:
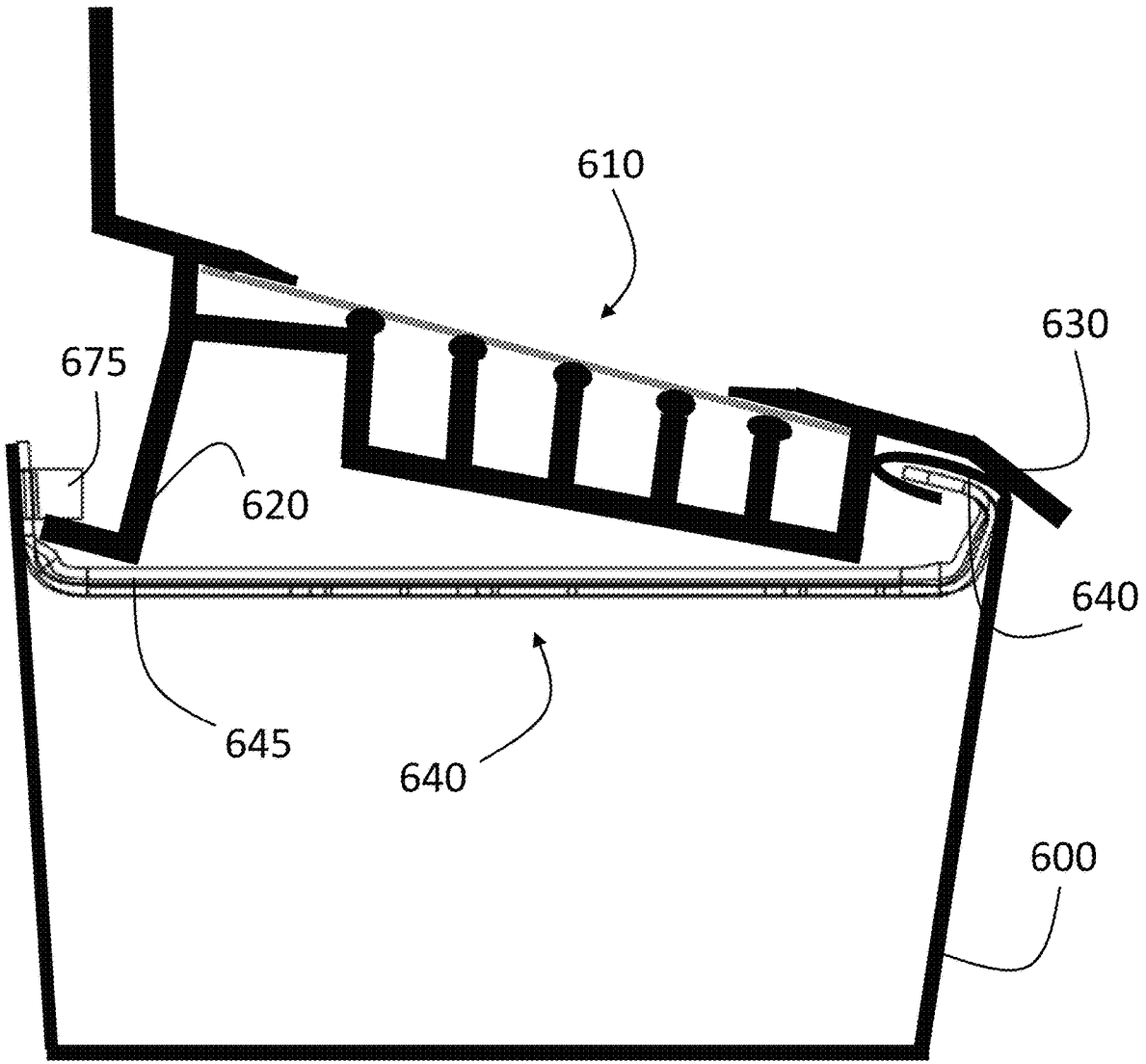
FIG. 13 schematically illustrates a side view of the hanger of FIG. 12 attached to a rain gutter and securing a gutter guard system.
Figure 14:
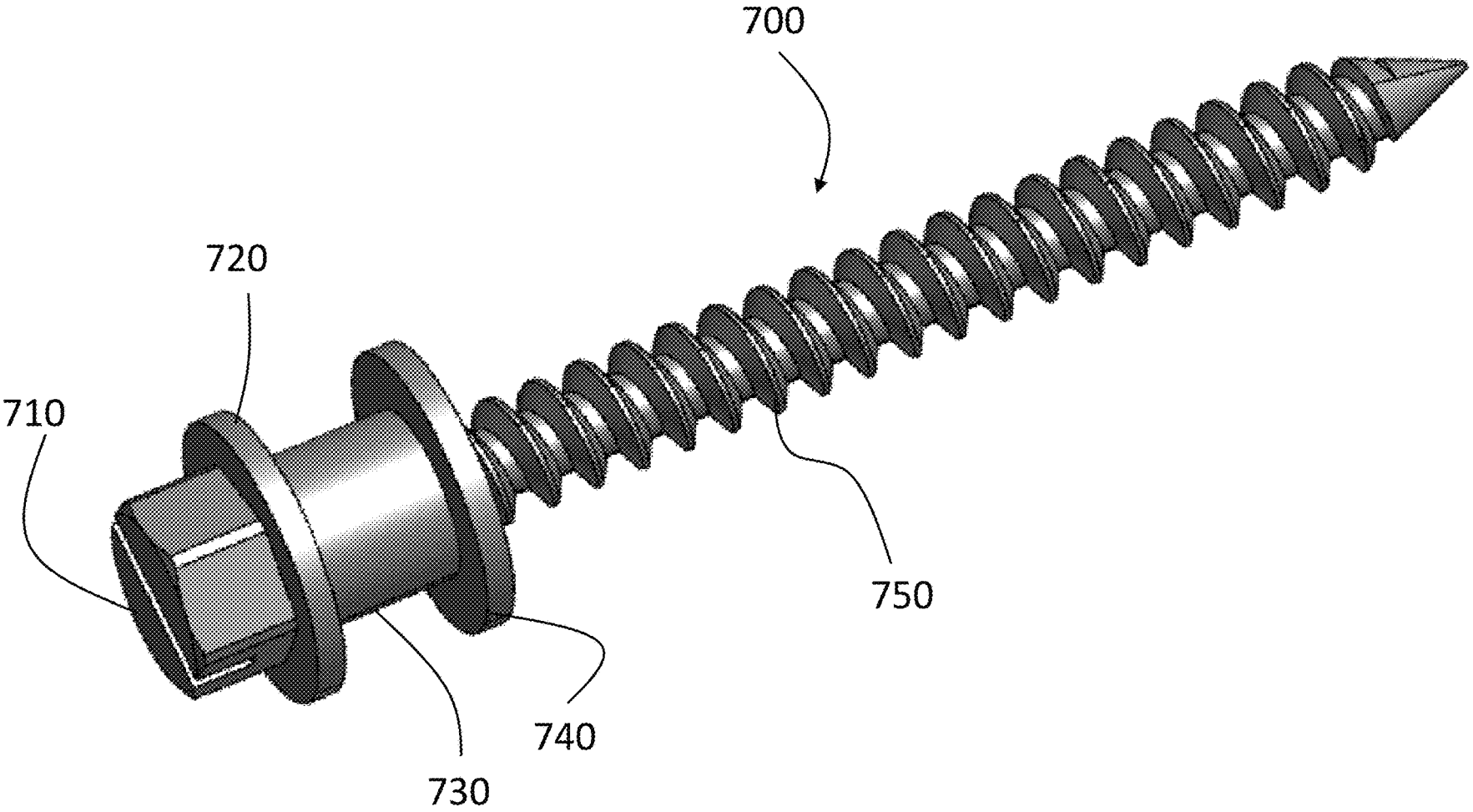
FIG. 14 schematically illustrates a perspective view of an exemplary fastener for use in installing or repairing a gutter guard system.

FIG. 13 schematically illustrates the clipless hanger 640 secured to a rain gutter 600 and a gutter guard system 610 secured and supported by the hanger 640. As illustrated, the leg 620 can be captured between the pair of ribs 670, 675 and the body 645 of the hanger 640 such that the gutter guard system 610 is secured and vertical movement of the gutter guard system 610 is constrained.

As with the prior described clip 100 and clipped hanger 500, from the description and illustrations herein, it will be understood that the clipless hanger 640 provides an installer with an additional component that is easy to attach to a rain gutter that can be used to position and secure gutter guard systems within a rain gutter either for a new installation of for repair and reinstallation of a gutter guard system.

Figure 15:
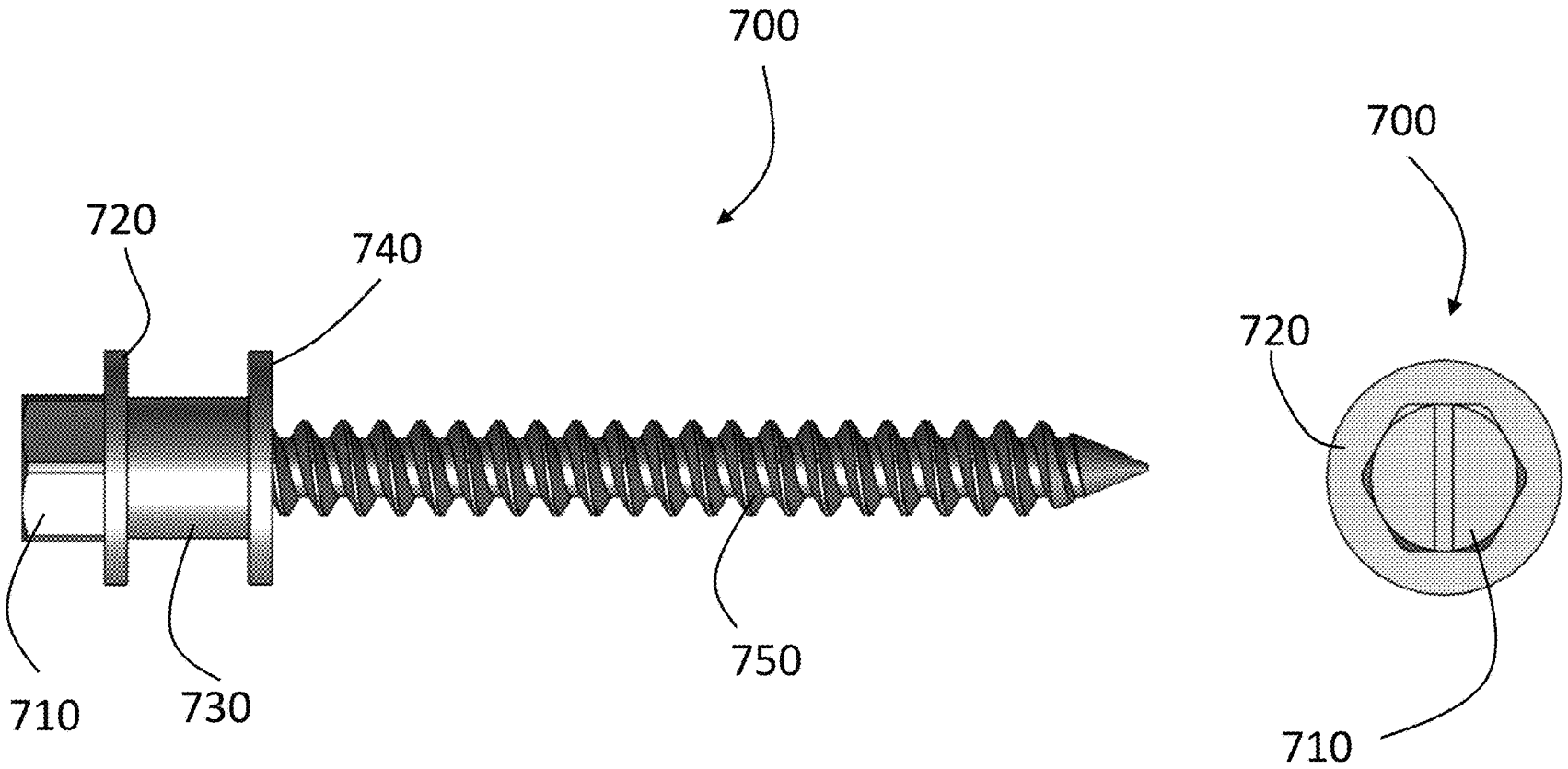
FIG. 15 schematically illustrates exemplary dimensions of the fastener of FIG. 14.

FIGS. 14-17 illustrate a novel fastener 700 useful for installing and repairing gutter guard systems. The fastener 700 includes a head 710, a flange 720 extending outward from the bottom of the head 710, a cylindrical section 730, a floating washer 740, and a threaded section 750. The flange 720 is fixed to the bottom of the head 710. The floating washer 740 can rotate but is restrained on one end by the flange 720 and on the other end by a raised thread. The diameter of an aperture through the floating washer 740 is larger than the diameter of the cylindrical section 730; thus, the floating washer 740 is free to move along the cylindrical section 730 between the flange 720 and threaded section 750. As arranged prior to use, the floating washer 740 is generally static in its position and the cylindrical section 730 is defined by the length between the flange 720 and floating washer 740. As will be further explained, once the fastener 700 is installed, the positions of the head 710, flange 720, cylindrical section 730, and floating washer 740 are arranged to support and secure a gutter guard system installed in a rain gutter. FIG. 15 depicts additional views of the fastener 700.

Figure 16:
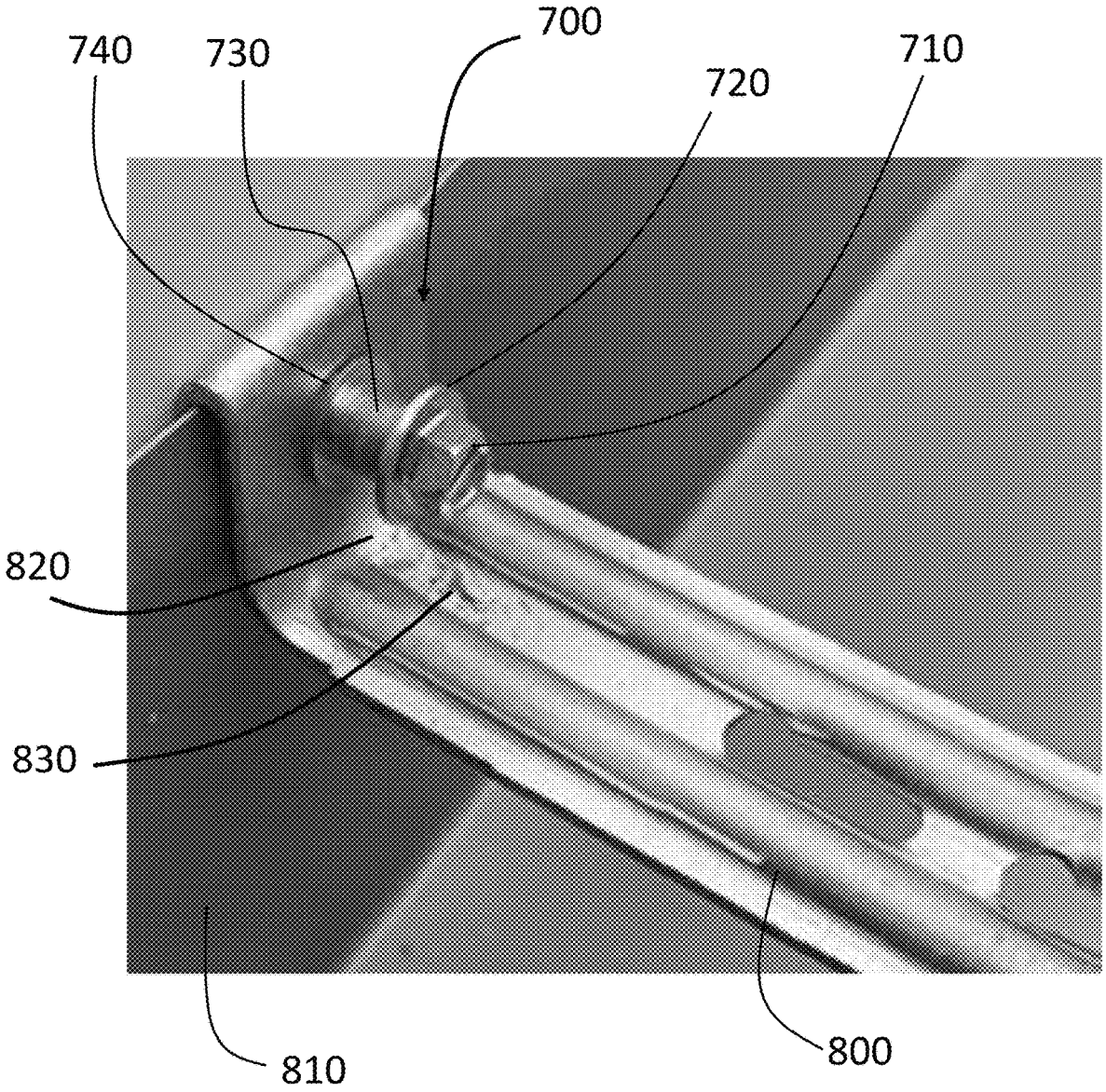
FIG. 16 is a photograph depicting the fastener of FIG. 14 attached to a rain gutter.
Figure 17:
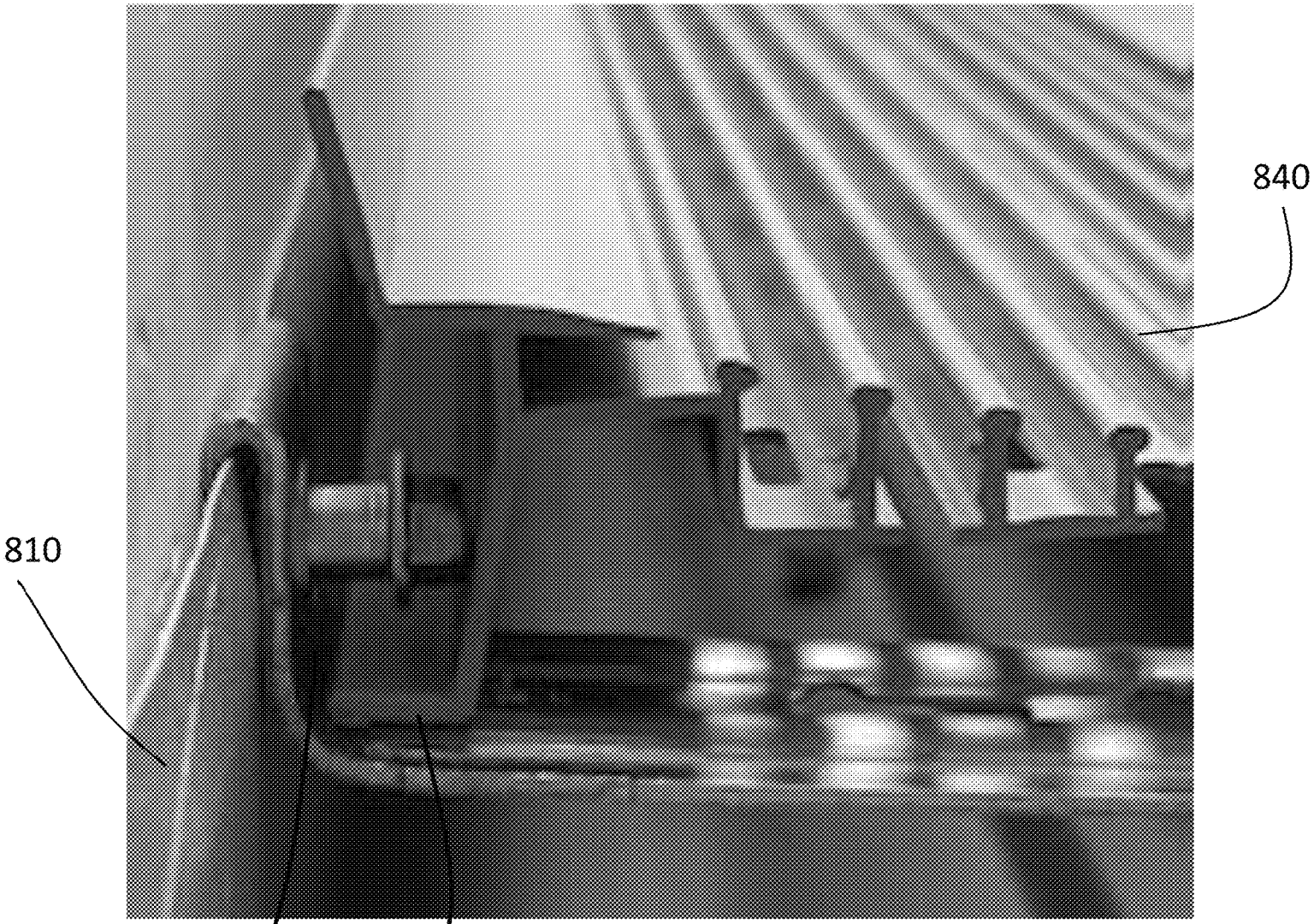
FIG. 17 is a photograph depicting the fastener of FIG. 14 attached to a rain gutter and securing a gutter guard system.

As illustrated in FIG. 16, the fastener 700 can be used to secure a hanger 800 to a rain gutter 810. The position of the fastener 700 is determined by the floating washer 740. The fastener 700 can be screwed through the rain gutter 810 and into the structure until the floating washer 740 engages with the surface of the hanger 800. Such an arrangement results in the head 710, flange 720, and cylindrical section 730 extending inward from the rear edge of the rain gutter 810 to form a gap 820 between the portions of the fastener 700 extending inward and the top surface of the body 830 of the hanger 800. As illustrated in FIG. 17, the gap 820 between portions of the fastener 700 extending inward and the top surface of the body 830 of the hanger 800 can be useful in supporting and securing a gutter guard system. A gutter guard system 840 can include a leg 850 extending rearward. An installer can insert the leg 850 into the gap 820 between the fastener 700 and the hanger 800. In such an arrangement, the head 710 of the fastener 700 can be arranged to engage with a portion of the leg 850 with another portion of the leg 850 engaging with the top surface of the body 830 of the hanger 800, which secures the gutter guard system 840 relative to the rain gutter 810. As will be understood, the dimensions and the relative positions of the head 710, flange 720, cylindrical section 730, and floating washer 740 of the fastener 700 can be arranged to match the dimensions and arrangement of the features of the gutter guard system to effectively secure the gutter guard system.

The novel fastener 700 provides an installer with yet an additional component that is easy to attach and install that can be used to position and secure gutter guard systems within a rain gutter either for a new installation of for repair and reinstallation of a gutter guard system.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

We claim:

1. A clip for attachment to a rain gutter and for supporting a gutter guard system, the clip comprising:

a back section extending in a generally upward direction, the back section comprising:

a first flat member extending in the upward direction, a second flat member extending in the upward direction that is disposed forward of, and generally parallel to, the first flat member and forming a slot between the first member and the second member, and a rounded member joining the first member to the second member at adjacent upper ends thereof;

a front section extending horizontally forward from a bottom edge of the upward extending second flat member of the upward extending back section, and having opposing first and second lateral side edges;

a first side member connected to and extending upward from the first lateral side edge of the front section, the first side member including a first body disposed at a lower portion of the first side member, a first arm disposed above the first body and extending in a horizontally forward direction, and a first opening defined between an upper edge of the first body and a bottom edge of the first arm; and a second side member connected to and extending upward from the second lateral side edge of the front section, the second side member including a second body disposed at a lower portion of the second side member, a second arm disposed above the second body and extending in a horizontally forward direction, and a second opening defined between an upper edge of the second body and a bottom edge of the second arm.

2. The clip of claim 1, wherein the back section and front section are generally perpendicular to each other.

3. The clip of claim 1, wherein the back section and front section are arranged at an obtuse angle to each other.

4. The clip of claim 3, wherein the back section and front section are arranged at an angle of 100 degrees.

5. The clip of claim 1, wherein the slot is configured to accommodate an upward extending rear edge of the rain gutter to secure the clip to the rain gutter.

6. The clip of claim 1, further comprising an aperture defined through the back section.

7. The clip of claim 6, wherein the aperture is arranged to accommodate a fastener to further secure the clip to the rain gutter.

8. The clip of claim 1, wherein the first opening and second opening are configured to engage with a feature of the gutter guard system.

9. The clip of claim 8, wherein the feature of the gutter guard system accommodated by the first opening and the second opening is a rearward extending leg.

10. The clip of claim 1, further comprising a tail extending from the second member.

11. The clip of claim 1, wherein when the clip is configured to be attached to the rain gutter, support the gutter guard system, and constrain vertical movement of the gutter guard system.

12. The clip of claim 1, wherein the rounded member forms a passageway through the rounded member.

* * * * *